US010170894B2

(12) United States Patent
Minami

(10) Patent No.: US 10,170,894 B2
(45) Date of Patent: Jan. 1, 2019

(54) MULTIPOINT IGNITION DEVICE AND MULTIPOINT IGNITION ENGINE

(71) Applicant: MIYAMA, INC., Nagano-shi, Nagano (JP)

(72) Inventor: Katsuaki Minami, Nagano (JP)

(73) Assignee: Miyama, Inc., Nagano-shi, Nagano (JP)

( * ) Notice: Subject to any disclaimer, the term of this patent is extended or adjusted under 35 U.S.C. 154(b) by 0 days.

(21) Appl. No.: 15/897,352

(22) Filed: Feb. 15, 2018

(65) Prior Publication Data

US 2018/0241181 A1 Aug. 23, 2018

(30) Foreign Application Priority Data

Feb. 22, 2017 (JP) ..... 2017-045432

(51) Int. Cl.

| | |
|---|---|
| ***H01T 13/46*** | (2006.01) |
| ***H01T 13/08*** | (2006.01) |
| ***F02P 15/08*** | (2006.01) |
| ***F02F 11/00*** | (2006.01) |
| ***F02P 13/00*** | (2006.01) |
| ***F02P 15/02*** | (2006.01) |
| ***H01T 13/40*** | (2006.01) |
| *F02B 23/08* | (2006.01) |
| *H01T 13/32* | (2006.01) |

(52) U.S. Cl.

CPC ..... *H01T 13/462* (2013.01); *F02F 11/002* (2013.01); *F02P 13/00* (2013.01); *F02P 15/02* (2013.01); *F02P 15/08* (2013.01); *H01T 13/08* (2013.01); *H01T 13/40* (2013.01); *F02B 2023/085* (2013.01); *H01T 13/32* (2013.01)

(58) Field of Classification Search

None

See application file for complete search history.

(56) References Cited

U.S. PATENT DOCUMENTS 2,719,514 A * 10/1955 Schilling ..... F02B 19/14 123/254
7,441,540 B1 * 10/2008 Minami ..... F02P 13/00 123/169 MG
2006/0102140 A1 * 5/2006 Sukegawa ..... F02B 23/101 123/297

FOREIGN PATENT DOCUMENTS

JP 1986296675 A 12/1986
JP 1990238176 9/1990
JP 2007056731 A 3/2007

* cited by examiner

*Primary Examiner* — Ashok Patel

(74) *Attorney, Agent, or Firm* — Greer Burns & Crain Ltd.

(57) ABSTRACT

A multipoint ignition device for igniting an air-fuel mixture in a combustion chamber of an engine includes: an insulating member formed in an annular shape such that an inner periphery thereof faces the combustion chamber; and a plurality of electrodes held on the insulating member so as to form a plurality of ignition gaps in a circumferential direction inside the combustion chamber, wherein the insulating member includes a plurality of divided insulating members formed in divided form, and the divided insulating member close to an intake valve of the engine has a higher thermal conductivity than the divided insulating member close to an exhaust valve of the engine.

7 Claims, 7 Drawing Sheets

MULTIPOINT IGNITION DEVICE AND MULTIPOINT IGNITION ENGINE

This application claims priority based on Japanese Patent Application No. 2017-045432 filed with the Japan Patent Office on Feb. 22, 2017, the entire contents of which are incorporated into this specification.

TECHNICAL FIELD

The present invention relates to a multipoint ignition device having a plurality of ignition gaps, and a multipoint ignition engine that includes the multipoint ignition device.

BACKGROUND ART

JP2007-056731A discloses a multipoint type ignition device having an ignition plate. In this multipoint type ignition device, the ignition plate includes a plate-shaped insulating body formed from ceramic and disposed between a cylinder head and a cylinder block, and a spark generating conductor wire that is held by the plate-shaped insulating body in order to form a spark generation gap in a combustion chamber.

SUMMARY OF INVENTION

However, in the multipoint type ignition device disclosed in JP2007-056731A, a plurality of spark generating conductor wires for forming a plurality of spark generation gaps are embedded in the ceramic plate-shaped insulating body so as to be formed integrally therewith, and therefore the multipoint type ignition device has a structure that is difficult to manufacture.

An object of the present invention is to provide a multipoint ignition device having a structure that is easy to manufacture.

According to one aspect of this invention, a multipoint ignition device for igniting an air-fuel mixture in a combustion chamber of an engine is provided, that includes: an insulating member formed in an annular shape such that an inner periphery thereof faces the combustion chamber; and a plurality of electrodes held on the insulating member so as to form a plurality of ignition gaps in a circumferential direction inside the combustion chamber, the insulating member includes a plurality of divided insulating members formed in divided form, and the divided insulating member close to an intake valve of the engine has a higher thermal conductivity than the divided insulating member close to an exhaust valve of the engine.

According to another aspect of this invention, a multipoint ignition engine including the multipoint ignition device as described above is provided.

According to these aspects, the multipoint ignition device includes the divided insulating members formed in divided form. There is therefore no need to form a multipoint ignition device having a plurality of electrodes integrated therewith, and instead, the multipoint ignition device can be manufactured by forming the divided insulating members separately and then combining the separately formed divided insulating members. As a result, a multipoint ignition device having a structure that is easy to manufacture can be provided.

DESCRIPTION OF EMBODIMENT

Embodiments of the present invention will be described below with reference to the figures.

First Embodiment

Figure 1:
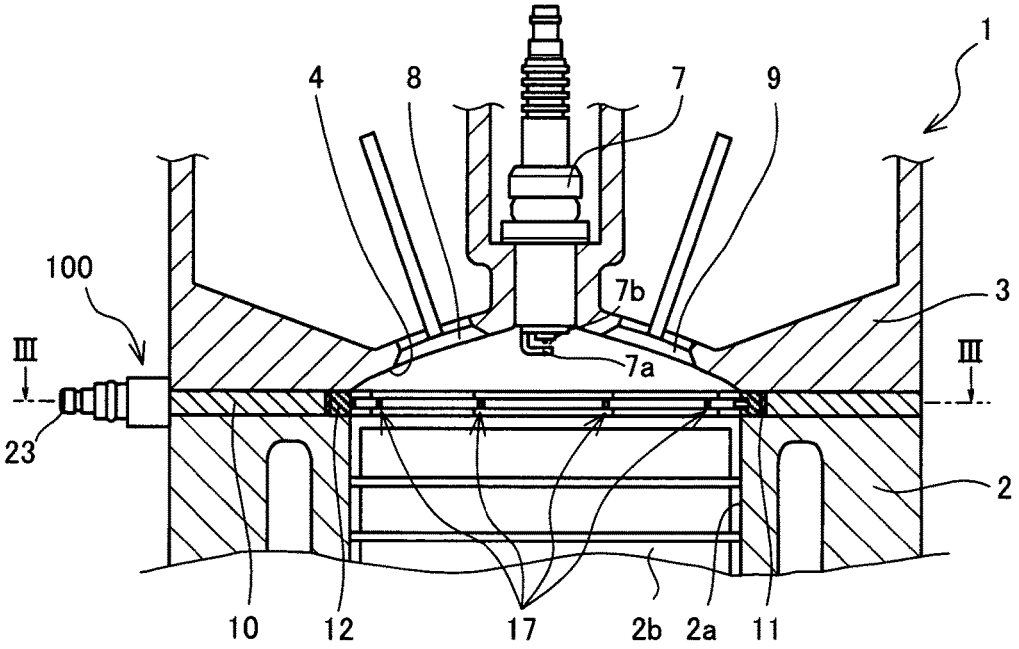
FIG. 1 is a sectional side view illustrating a condition in which a multipoint ignition device according to a first embodiment of the present invention is attached to an engine.
Figure 2A:
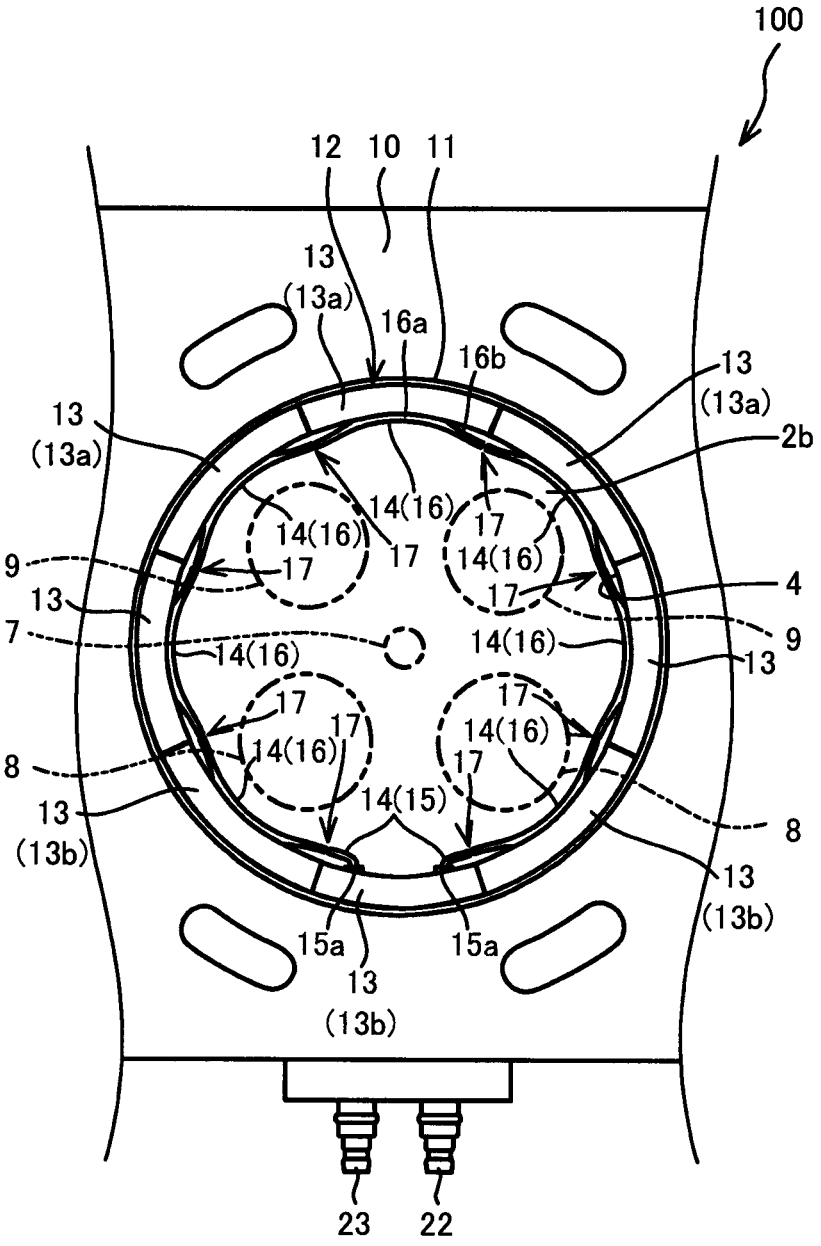
FIG. 2A is a plan view of the multipoint ignition device according to the first embodiment of the present invention.
Figure 2B:
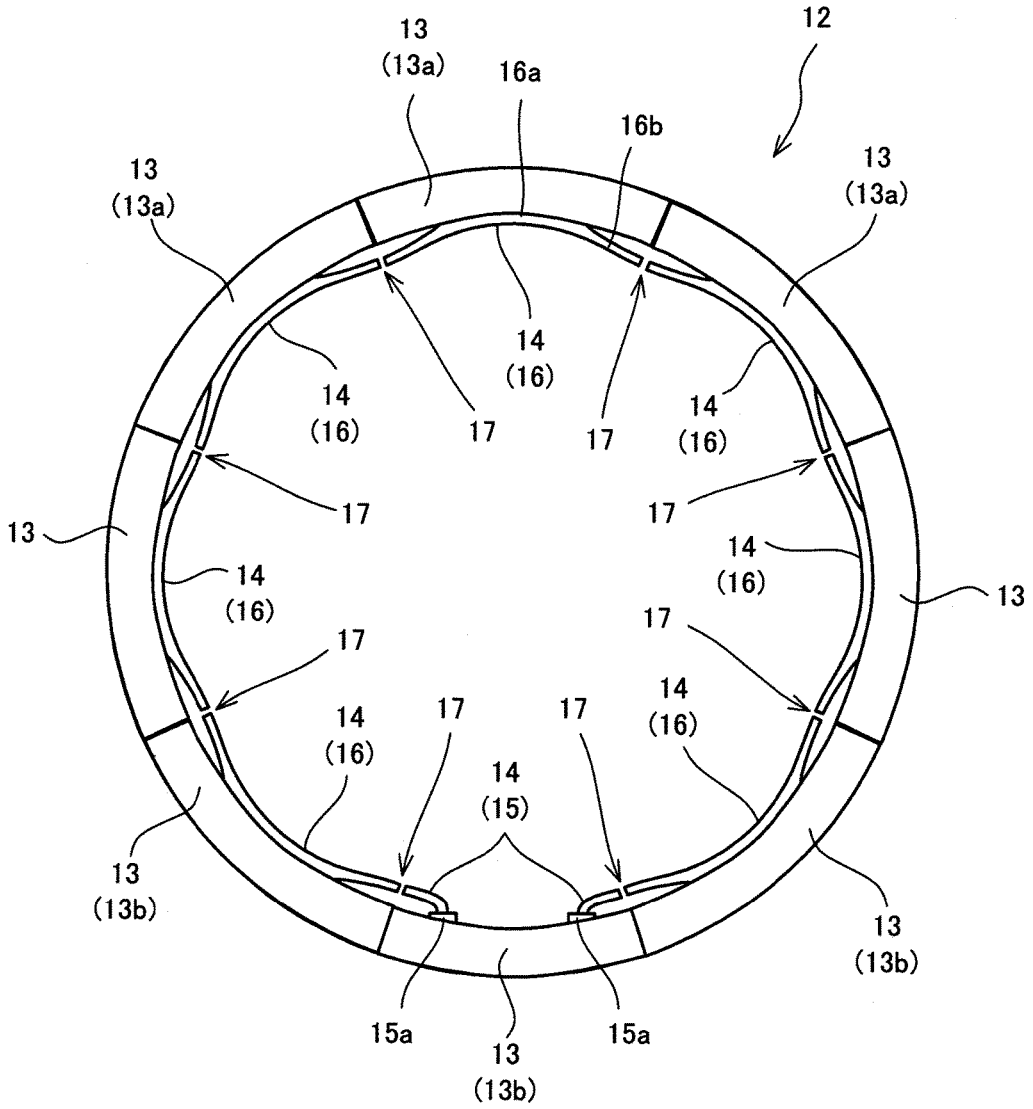
FIG. 2B is an enlarged portion of FIG. 2A.
Figure 3:
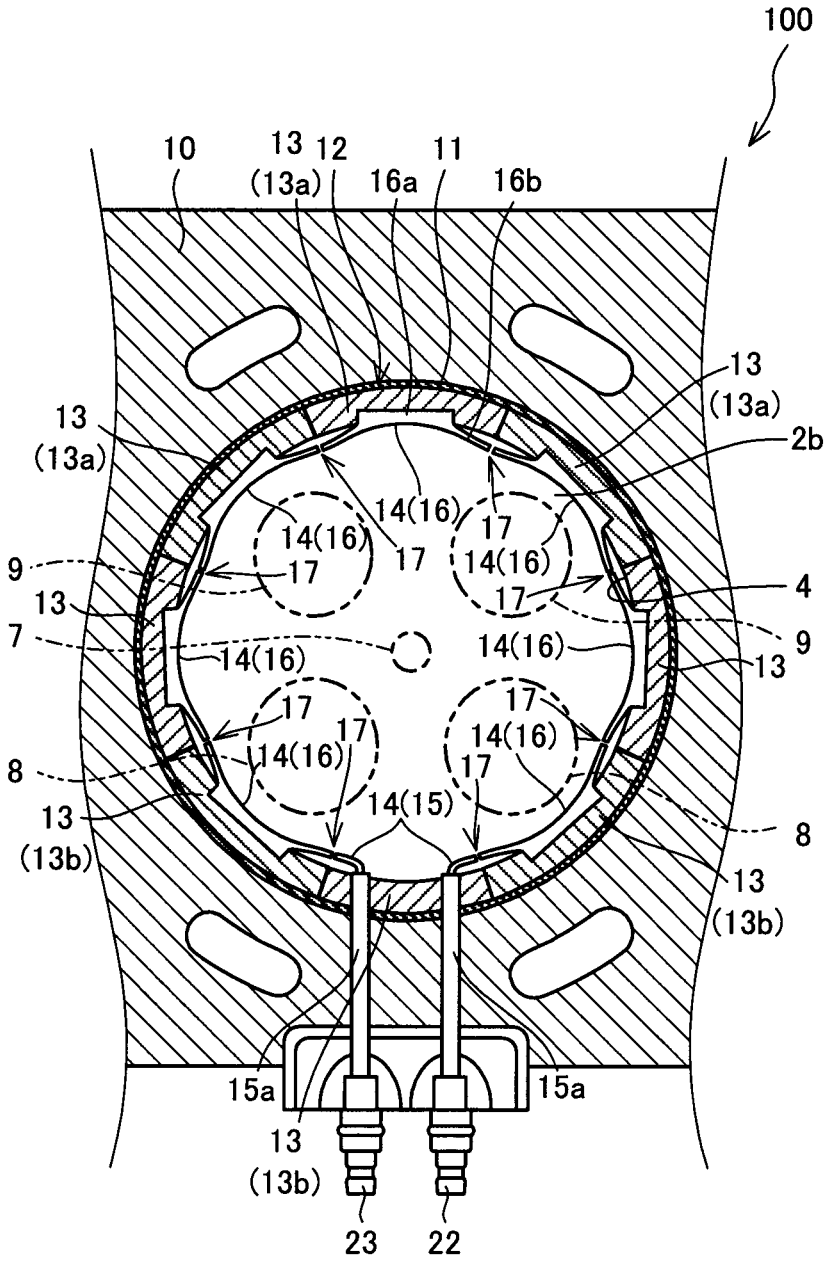
FIG. 3 is a III-III sectional view of FIG. 1.

Referring to FIGS. 1 to 3, a multipoint ignition device 100 according to a first embodiment of the present invention will be described.

First, referring to FIG. 1, a configuration of a multipoint ignition engine (referred to simply as "the engine" hereafter) 1 that includes the multipoint ignition device 100 will be described.

As shown in FIG. 1, the engine 1 includes a cylinder block 2, a cylinder 2*a* formed in the cylinder block 2, a piston 2*b* that reciprocates through the cylinder 2*a*, a cylinder head 3 that is attached to the cylinder block 2 in order to close a top portion of the cylinder 2*a*, a spark plug 7, and the multipoint ignition device 100, which is provided between the cylinder block 2 and the cylinder head 3. A combustion chamber 4 is formed by the cylinder 2*a*, the piston 2*b*, and the cylinder head 3.

The spark plug 7 is disposed in an upper portion of the combustion chamber 4. The engine 1 is a spark ignition internal combustion engine that obtains power when the multipoint ignition device 100 and the spark plug 7 ignite and burn a compressed air-fuel mixture in the combustion chamber 4.

In the engine 1, the compressed air-fuel mixture in the combustion chamber 4 is ignited by the multipoint ignition device 100 and the spark plug 7. More specifically, an ignition current from an ignition coil (not shown) is input from an input terminal 22, whereby sparks are generated in a plurality of ignition gaps 17 of the multipoint ignition device 100 and an ignition gap 7*b* of the spark plug 7.

Hence, in the engine 1, ignition is executed by the multipoint ignition device 100 in addition to the spark plug 7, and therefore a flame flow can be generated by combustion. Accordingly, rapid combustion can be realized without providing a squish area, and as a result, cooling loss can be reduced.

Next, referring to FIGS. 2A, 2B and 3, a configuration of the multipoint ignition device 100 will be described.

As shown in FIGS. 2A and 2B, the multipoint ignition device 100 includes a main body portion 10, a ring body 11, an insulating member 12, and a plurality of electrodes 14.

The main body portion 10 is provided between the cylinder block 2 and the cylinder head 3. The main body portion 10 may be used as a gasket, or a gasket (not shown) may be provided separately to the main body portion 10. The main body portion 10 is formed from a metal such as aluminium alloy, for example.

The input terminal 22 into which the input current is input from the ignition coil, and a connection terminal 23 connected either to the input terminal 22 of another multipoint ignition device 100 or to the spark plug 7 are provided in the main body portion 10.

Hence, the multipoint ignition device 100 of another cylinder 2*a* can be connected in series to the front of the multipoint ignition device 100 via a plug cord (not shown) such that ignition can be executed by both multipoint ignition devices 100 simultaneously. Further, the multipoint ignition device 100 and the spark plug 7 provided in one combustion chamber 4 can be connected to each other in series via a plug cord (not shown) so as to execute ignition simultaneously. At this time, an earth electrode 7*a* of the spark plug 7 is earthed by contacting the cylinder head 3.

The ring body 11 is provided between the main body portion 10 and the insulating member 12. The ring body 11 holds an outer periphery of the insulating member 12 on the main body portion 10. An outer periphery of the ring body 11 is formed at an identical size to an inner periphery of the main body portion 10. An inner periphery of the ring body 11 is formed at an identical size to the outer periphery of the insulating member 12.

The ring body 11 is formed from a material that deforms elastically more easily than the insulating member 12. For example, the ring body 11 is formed from a foamed metal such as foamed aluminium. The ring body 11 absorbs a shock generated when the air-fuel mixture is burned in the combustion chamber 4. Therefore, by providing the ring body 11, the insulating member 12 can be protected from the shock generated when the air-fuel mixture is burned in the combustion chamber 4.

The insulating member 12 is formed in an annular shape such that an inner periphery thereof faces the combustion chamber 4. The insulating member 12 is formed from an insulator such as ceramic, for example. The insulating member 12 includes a plurality of divided insulating members 13 formed in divided form.

The divided insulating members 13 respectively hold the electrodes 14. Each divided insulating member 13 holds either a pair of side electrodes 15 or a single intermediate electrode 16, as will be described below. The ignition gaps 17 are respectively formed to face seams between adjacent divided insulating members 13. The divided insulating members 13 are held on the main body portion 10 via the ring body 11. The divided insulating members 13 are connected to each other by an adhesive, a brazing material, or the like. The divided insulating members 13 are connected to the main body portion 10 by an adhesive, a brazing material, or the like.

Hence, the multipoint ignition device 100 includes the divided insulating members 13 formed in divided form. The divided insulating members 13 respectively hold the electrodes 14. There is therefore no need to form a multipoint ignition device having a plurality of electrodes integrated therewith, and instead, the multipoint ignition device 100 can be manufactured by forming the divided insulating members 13 separately and then combining the separately formed divided insulating members 13. As a result, a multipoint ignition device 100 having a structure that is easy to manufacture can be provided.

Further, when one of the intermediate electrodes 16 is damaged, for example, only the divided insulating member 13 holding the damaged intermediate electrode 16 need be exchanged for a new one. Hence, there is no need to exchange the entire multipoint ignition device 100.

The divided insulating members 13 are formed by dividing the annular insulating member 12 in a circumferential direction. The divided insulating members 13 include an exhaust side insulating member 13*a* that is close to an exhaust valve 9 of the engine 1, and an intake side insulating member 13*b* that is close to an intake valve 8 of the engine 1. The intake side insulating member 13*b* has a higher thermal conductivity than the exhaust side insulating member 13*a*.

Hence, with the single multipoint ignition device 100, a heat value on the intake valve 8 side, where the temperature rises less easily, can be reduced, and a heat value on the exhaust valve 9 side, where the temperature rises more easily, can be increased.

It should be noted that not all of the divided insulating members 13 need to hold the electrodes 14. For example, the annular insulating member 12 may be formed by alternately combining a divided insulating member 13 holding an electrode 14 and a divided insulating member 13 not holding an electrode 14. In this case, the electrodes 14 are formed to be longer in the circumferential direction than the divided insulating members 13.

The electrodes 14 are held by the insulating member 12 so as to form the plurality of ignition gaps 17 in the circumferential direction inside the combustion chamber 4. The electrodes 14 include the pair of side electrodes 15 and the plurality of intermediate electrodes 16.

The side electrodes 15 are held on a single divided insulating member 13. The side electrodes 15 are held on the divided insulating member 13 via insulators 15*a*. The side electrodes 15 are formed to extend around an inner periphery of the combustion chamber 4 in opposite directions.

The insulators 15*a* project partially from an inner peripheral surface of the divided insulating member 13, and are formed to be long enough to penetrate the main body portion 10.

A first side electrode 15 penetrates the insulating member 12 and the main body portion 10 so as to extend to the input terminal 22. Similarly, a second side electrode 15 penetrates the insulating member 12 and the main body portion 10 so as to extend to the connection terminal 23. The ignition current from the ignition coil is input into the first side electrode 15 via the input terminal 22.

The intermediate electrodes 16 are provided in series in a row between the first side electrode 15 and the second side electrode 15. Each intermediate electrode 16 forms an ignition gap 17 with the intermediate electrode 16 that is adjacent thereto. The intermediate electrodes 16 that are adjacent to the side electrodes 15 form ignition gaps 17 with the side electrodes 15.

The intermediate electrodes 16 project into the combustion chamber 4 from the insulating member 12. The intermediate electrodes 16 each include a support portion 16*a* held on the insulating member 12, and an electrode portion 16*b* formed integrally with the support portion 16*a* and positioned inside the combustion chamber 4.

The support portion 16*a* is configured such that a base end portion thereof is held on the divided insulating member 13 and a tip end portion thereof projects into the combustion chamber 4.

The electrode portion 16*b* is provided on the tip end portion of the support portion 16*a*. The electrode portion 16*b* is formed in an arc shape extending around an inner peripheral surface of the combustion chamber 4. The ignition gap 17 is formed at each end of the electrode portion 16*b*.

The electrode portion 16*b* is exposed to the interior of the combustion chamber 4 over the entire length thereof. Therefore, when the air-fuel mixture is burned in the combustion chamber 4, the entire electrode portion 16*b* is heated. Accordingly, a large surface area is exposed to the flame, and as a result, the heat value can be reduced.

According to the first embodiment, described above, following effects are obtained.

The multipoint ignition device 100 includes the divided insulating members 13 formed so as to be divided in the circumferential direction. The divided insulating members 13 respectively hold the electrodes 14. There is therefore no need to form a multipoint ignition device having a plurality of electrodes integrated therewith, and instead, the multipoint ignition device 100 can be manufactured by forming the divided insulating members 13 separately and then combining the separately formed divided insulating members 13. As a result, a multipoint ignition device 100 having a structure that is easy to manufacture can be provided.

Second Embodiment

Figure 4A:
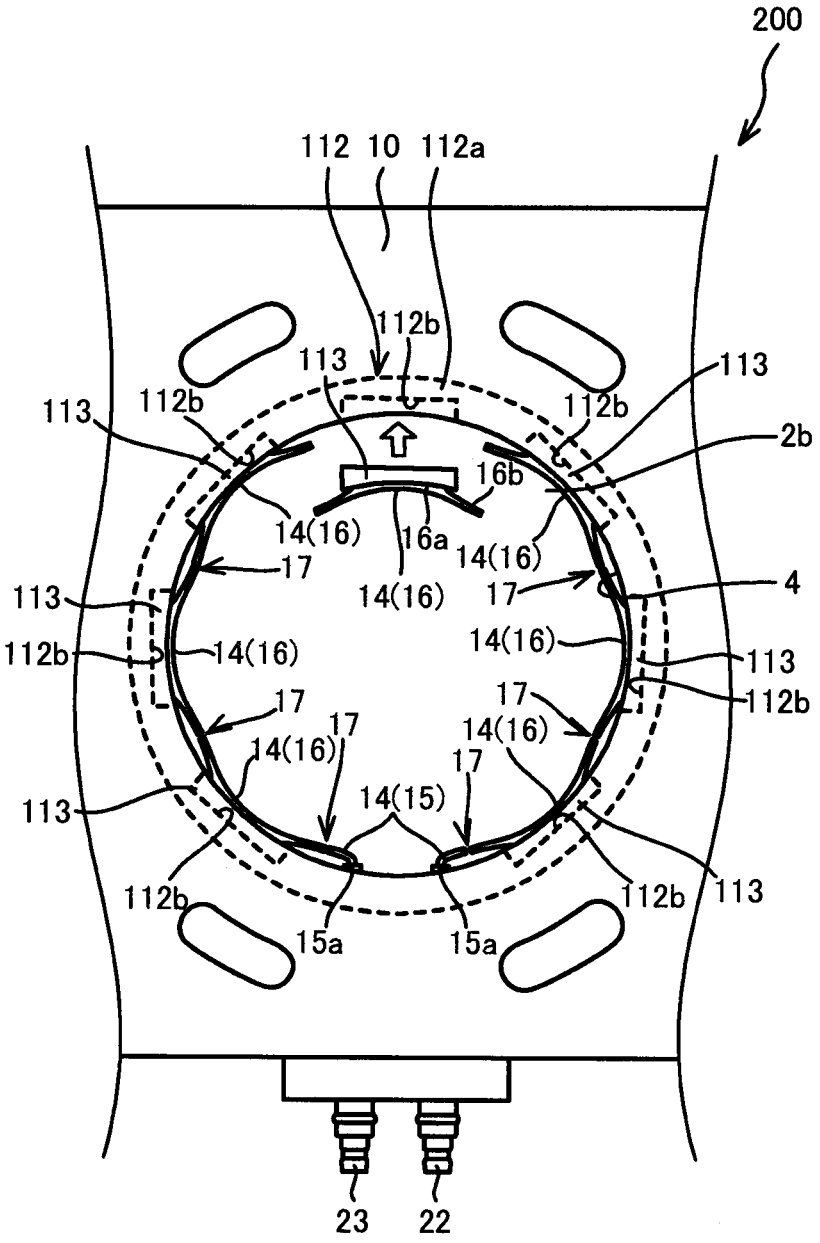
FIG. 4A is a plan view of a multipoint ignition device according to a second embodiment of the present invention, and a view showing a condition before attaching one divided insulation member.
Figure 4B:
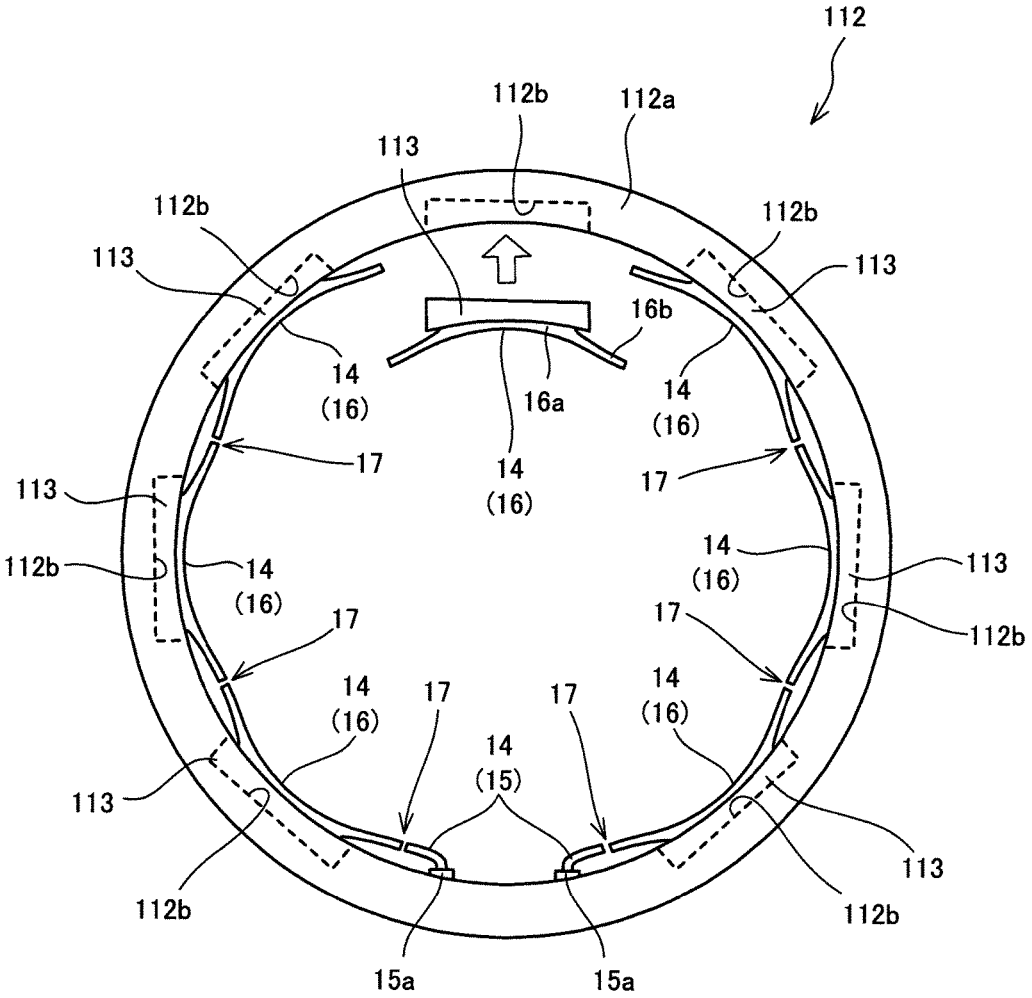
FIG. 4B is an enlarged portion of FIG. 4A.
Figure 5:
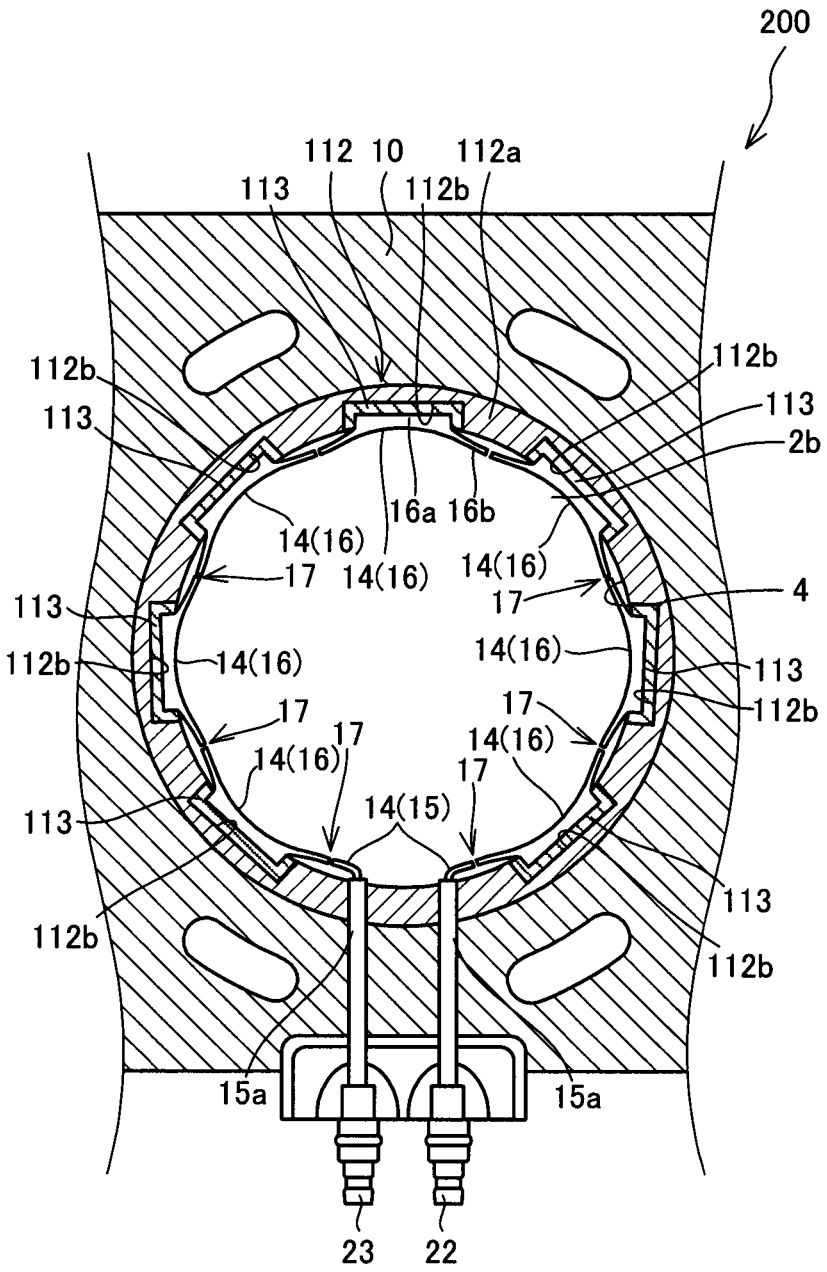
FIG. 5 is a sectional plan view of the multipoint ignition device according to the second embodiment of the present invention.

Referring to FIGS. 4A, 4B and 5, a multipoint ignition device 200 according to a second embodiment of the present invention will be described.

In the multipoint ignition device 200, an insulating member 112 has a different structure to that of the multipoint ignition device 100.

The insulating member 112 includes an annular insulating member 112*a*, and divided insulating members 113. The ring body 11 (see FIGS. 2A, 2B and 3) may be provided on an outer periphery of the insulating member 112.

The annular insulating member 112*a* is formed in an annular shape. The annular insulating member 112*a* is embedded in the main body portion 10 so as to be exposed to the inner peripheral surface of the main body portion 10. Insertion holes 112*b* having an identical shape to an outer shape of the divided insulating member 113 are formed in an inner peripheral surface of the annular insulating member 112*a*.

The insertion holes 112*b* are formed in the annular insulating member 112*a* up to a midway point in a radial direction thereof. The insertion holes 112*b* do not penetrate the annular insulating member 112*a*. A depth of the insertion holes 112*b* is set such that when the divided insulating members 113 are inserted, the inner peripheral surface of the annular insulating member 112*a* is flush with respective inner peripheral surfaces of the divided insulating members 113. Adjacent insertion holes 112*b* are formed at a circumferential direction interval.

The divided insulating members 113 are inserted into the insertion holes 112*b*. The inner peripheral surface of each divided insulating member 113 is formed to have an identical curvature to the inner peripheral surface of the annular insulating member 112*a*. The divided insulating members 113 are held on the annular insulating member 112*a* via the ring body 11. The divided insulating members 113 are connected to the annular insulating member 112*a* by an adhesive, a brazing material, or the like. The divided insulating members 113 are connected to the main body portion 10 by an adhesive, a brazing material, or the like.

According to the second embodiment, described above, similarly to the first embodiment, the multipoint ignition device 200 can be manufactured by forming the divided insulating members 113 separately and then incorporating the separately formed dividing insulating members 113 into the annular insulating member 112. As a result, a multipoint ignition device 200 having a structure that is easy to manufacture can be provided.

Embodiments of this invention were described above, but the above embodiments are merely examples of applications of this invention, and the technical scope of this invention is not limited to the specific constitutions of the above embodiments.

For example, in the multipoint ignition device 100, 200, the divided insulating members 13, 113 each hold a single intermediate electrode 16, but may hold two or more intermediate electrodes 16. Further, the pair of side electrodes 15 are held by a single divided insulating member 13, 113, but divided insulating members 13, 113 for holding each of the side electrodes 15 may be provided.

The embodiments of this invention in which an exclusive property or privilege is claimed are defined as follows:

What is claimed is:

1. A multipoint ignition device for igniting an air-fuel mixture in a combustion chamber of an engine, comprising:

an insulating member formed in an annular shape such that an inner periphery thereof faces the combustion chamber; and a plurality of electrodes held on the insulating member so as to form a plurality of ignition gaps in a circumferential direction inside the combustion chamber, wherein the insulating member includes a plurality of divided insulating members formed in divided form, and the divided insulating member close to an intake valve of the engine has a higher thermal conductivity than the divided insulating member close to an exhaust valve of the engine.

2. The multipoint ignition device according to claim 1, wherein the electrodes include:

a side electrode provided in a pair; and a plurality of intermediate electrodes provided between the side electrodes so as to form the plurality of ignition gaps, and the intermediate electrodes project into the combustion chamber from the insulating member so as to be exposed to the interior of the combustion chamber over an entire length thereof.

3. The multipoint ignition device according to claim 1, wherein the plurality of divided insulating members respectively holds the electrodes.

4. The multipoint ignition device according to claim 1, wherein the divided insulating members are formed by dividing the insulating member formed in an annular shape in a circumferential direction.

5. The multipoint ignition device according to claim 4, wherein the ignition gaps are formed so as to face seams between adjacent the divided insulating members.

6. The multipoint ignition device according to claim 3, wherein the insulating member includes an annular insulating member formed in an annular shape, and the divided insulating members are inserted into insertion holes formed in an inner peripheral surface of the annular insulating member.

7. A multipoint ignition engine comprising a multipoint ignition device according to claim 1.

* * * * *